US007489078B2

(12) United States Patent
Krönert et al.

(10) Patent No.: US 7,489,078 B2
(45) Date of Patent: Feb. 10, 2009

(54) HIGH-PRESSURE DISCHARGE LAMP

(75) Inventors: Uwe Krönert, Wolfstein (DE); Jeremy Woffendin, Cambridge (GB); Michael Fletcher, Cambridge (GB)

(73) Assignee: Heraeus Noblelight Ltd., Cambridge (GB)

( * ) Notice: Subject to any disclaimer, the term of this patent is extended or adjusted under 35 U.S.C. 154(b) by 393 days.

(21) Appl. No.: 11/366,791

(22) Filed: Mar. 2, 2006

(65) Prior Publication Data

US 2006/0202604 A1 Sep. 14, 2006

(30) Foreign Application Priority Data

Mar. 4, 2005 (GB) ..... 0504548.9

(51) Int. Cl.
*H01J 61/88* (2006.01)

(52) U.S. Cl. ..... 313/574; 313/631; 313/632

(58) Field of Classification Search ..... None
See application file for complete search history.

(56) References Cited

U.S. PATENT DOCUMENTS

| | | | | |
|---|---|---|---|---|
| 3,474,278 | A | 10/1969 | Thouret et al. | |
| 3,705,325 | A * | 12/1972 | Austad | 313/634 |
| 4,001,624 | A * | 1/1977 | Cosco et al. | 313/573 |
| 4,503,356 | A * | 3/1985 | Kobayashi et al. | 313/634 |
| 4,779,026 | A * | 10/1988 | Heider et al. | 313/631 |
| 5,979,187 | A * | 11/1999 | Churchley et al. | 65/32.2 |
| 6,531,832 | B1 | 3/2003 | Hirata | |
| 2004/0169476 | A1 | 9/2004 | Ehrlichmann et al. | |

FOREIGN PATENT DOCUMENTS

| | | | |
|---|---|---|---|
| EP | 0 374 679 | B1 | 3/1995 |
| EP | 1 227 510 | A1 | 7/2002 |
| GB | 2 199 693 | A | 7/1988 |
| JP | 08-124521 | A | 5/1996 |
| SU | 1356038 | A1 | 11/1987 |

* cited by examiner

*Primary Examiner*—Ashok Patel
(74) *Attorney, Agent, or Firm*—Panitch Schwarze Belisario & Nadel LLP

(57) ABSTRACT

A high-pressure discharge lamp has a pressure chamber with two opposite end regions and delimited by a cylindrical envelope made of glass. An electrode is provided at each of the two end regions, the electrodes projecting into the pressure chamber and being arranged in the pressure chamber as anode and cathode. A discharge chamber is formed between the electrodes. The two end regions of the pressure chamber are designed differently at least outside of the discharge chamber.

11 Claims, 1 Drawing Sheet

HIGH-PRESSURE DISCHARGE LAMP

BACKGROUND OF THE INVENTION

The present invention relates to a high-pressure discharge lamp having a pressure chamber with two opposite ends and delimited by a cylindrical envelope made of glass. An electrode is provided at each of the ends, the electrodes projecting into the pressure chamber and being arranged in the pressure chamber as anode and cathode, such that a discharge chamber is formed between the electrodes. The invention relates, in particular, to a high-pressure discharge lamp that is used as a flash lamp.

High-pressure discharge lamps have already been disclosed in great variety, for example in European Patent EP 374 679 B 1 or in European published patent application EP 1 227 510 A1. Similar discharge lamps have, for example, also been disclosed in U.S. Pat. No. 5,979,187.

The use of high-pressure discharge lamps as flash lamps often gives rise to the problem that, in the course of lamp operation, the cylindrical envelope is devitrified approximately in its central region. As a result, the useful life of the lamp decreases to a considerable degree.

BRIEF SUMMARY OF THE INVENTION

For that reason, the present invention aims at providing a lamp whose service life is prolonged when it is operated in the flashing mode. According to the present invention, any signs of devitrification have been shown to become substantially less, if the two end regions of the pressure chamber are designed differently at least outside of the discharge chamber. The discharge chamber is defined as the space between the anode and the cathode. The pressure chamber is defined as the entire space inside the cylindrical envelope. As a result, the high-pressure discharge lamp according to the invention comprises an asymmetry in the pressure chamber outside of the discharge chamber in the end regions of the pressure chamber. It is assumed that the spatial asymmetry causes the development of asymmetric flow conditions which will then contribute to prolonging the service life of the lamp. The devitrification in the central region of the cylindrical envelope, preferably formed as a tube closed on both ends, is strongly reduced, in particular with flash lamps.

The cylindrical envelope is preferably made of quartz glass. It is advantageous if at least one of the electrodes is, at least substantially, designed in the form of a cylinder. It is beneficial to have a flow resistance that is lower in the end region comprising the anode than in the end region comprising the cathode (i.e., the flow cross-section at the cathode is smaller than at the anode). The radial spacing between the electrode and the cylindrical envelope may be at least approximately 200 μm greater at the anode than at the cathode.

It has also been shown to be advantageous if the anode comprises a through opening ending in the discharge chamber, wherein a bore preferably not running parallel, but preferably running perpendicular to the longitudinal axis, is connected to an axial bore.

It can, in addition, be beneficial to have at least one of the electrodes, at its region toward the associated end of the pressure chamber, comprise a cross-section that is reduced as compared with the region toward the discharge chamber. That means that the electrode that is substantially cylindrical in shape comprises a smaller diameter at the end at which the lead electrode passes into the cylindrical envelope, because this part of the electrode is formed by the lead electrode or power supply. It is, in general, also possible to have a radial spacing between the cylindrical envelope and at least one electrode that is greater at the region of the electrode toward the associated end of the pressure chamber than at the region toward the discharge chamber.

The diameter of the cylindrical envelope can, advantageously, be reduced at least in the region of one electrode, preferably the cathode, such that radial spacing from the electrode is reduced. As a result, the flow resistance at the cathode can be increased as compared with the flow resistance at the region of the anode. Appropriately, the diameter is not reduced along the complete longitudinal extension of the electrode, but preferably at its circumferential region toward the discharge chamber. Preferably, the cold fill pressure of the filling gas of the lamp is in the range of about 1.5-3 bar.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not delimited to the precise arrangements and instrumentalities shown. In the drawings.

DETAILED DESCRIPTION OF THE INVENTION

Figure 1:
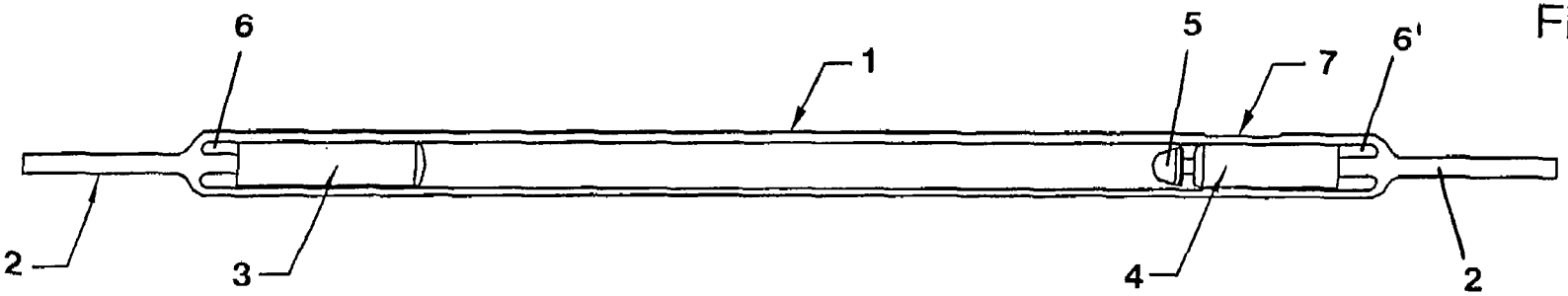
FIG. 1 is a schematic, longitudinal sectional view illustrating one embodiment of the invention.

FIG. 1 shows a high-pressure discharge lamp used as a flash lamp and comprising a cylindrical envelope 1 made of a quartz tube. The quartz tube is closed at both of its ends. A tungsten filament, which is provided as connection electrode 2, is passed through each of the closed ends. The connection electrode 2 is fused in the quartz glass.

One connection electrode 2 each runs respectively to the anode 3 and the cathode 4. Anode 3 and cathode 4 are substantially cylindrical in shape. The discharge chamber is provided between the anode 3 and the cathode 4. At its end facing the discharge chamber, the cathode comprises an electrode head 5 that is axially connected to the cylindrical cathode body. A cavity 6, 6' is provided between the lead-through of the lead electrodes 2 and the cylindrical bodies of the anode 3 and the cathode 4. In the embodiment according to FIG. 1, the two cavities 6, 6' are approximately equal in size, whereas in the embodiment according to FIG. 2, the cavity 6 assigned to the anode 3 exceeds in size the cavity 6' assigned to the cathode 4.

Figure 2:
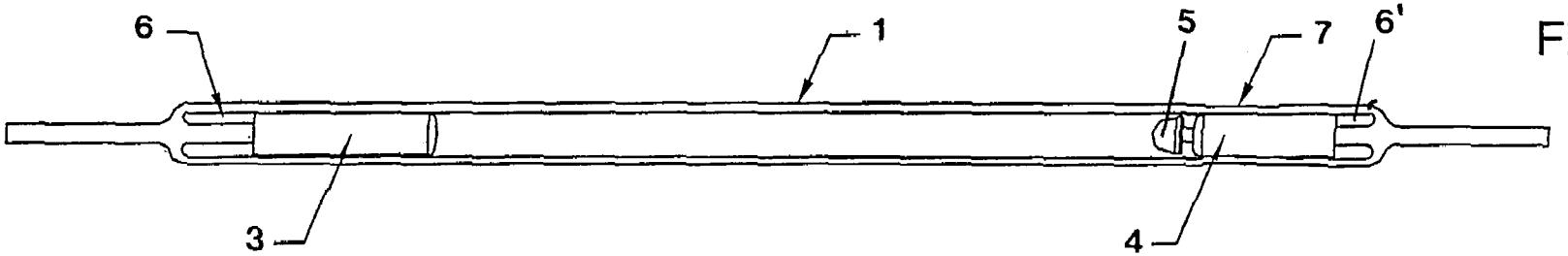
FIG. 2 is a schematic, longitudinal sectional view illustrating a similar embodiment of the invention.

In the embodiments according to FIGS. 1 and 2, the cylindrical envelope comprises a constriction 7 in the region of the circumferential surface of the cylindrical cathode 4. As a result, the spacing between the cathode 4 and the cylindrical envelope 1 is reduced to approximately 0.02 mm, whereas the spacing between the anode 3 and the cylindrical envelope 1 is approximately 0.25 mm, i.e., a difference of 0.23 mm or 230 μm. The constriction extends only along the forward lateral region of the cathode 4 toward the discharge chamber. In essence, the constriction 7 produces an asymmetry of the pressure chamber, such that the flow resistance at the cathode exceeds the flow resistance at the anode. The cold fill pressure of the filling gas of the lamp is about 2 bar.

Figure 3:
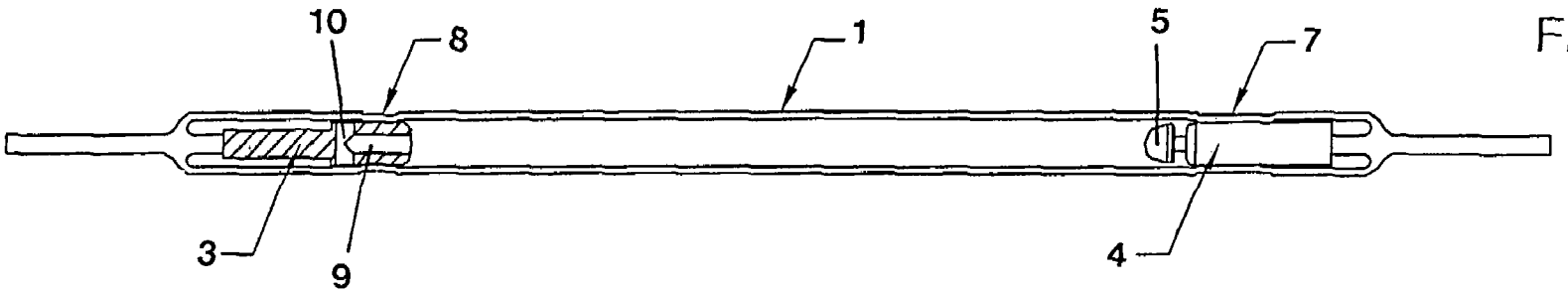
FIG. 3 is a schematic, longitudinal sectional view illustrating a further embodiment of the invention.

In the embodiment shown in FIG. 3, the region of the anode 3 also comprises a constriction 8, with the result that the spacing between the anode 3 and the cylindrical envelope 1 is approximately 0.02 mm in the region of the constriction 8 as well. The constriction extends only along the forward lateral region of the anode 3 toward the discharge chamber. Through this region the anode 3 comprises an axial bore 9 that connects the discharge chamber to a radial bore 10. The radial bore 10 ends in the pressure chamber between the constriction 8 and the end of the pressure chamber associated with the anode 3, with the result that a sort of bypass is formed. Thereby, the flow resistance at the anode is less than that at the cathode. To increase this effect, the diameter in the lateral region of the anode 3 away from the discharge chamber is less than that in the forward lateral region surrounded by the constriction 8.

It will be appreciated by those skilled in the art that changes could be made to the embodiments described above without departing from the broad inventive concept thereof. It is understood, therefore, that this invention is not delimited to the particular embodiments disclosed, but it is intended to cover modifications within the spirit and scope of the present invention as defined by the appended claims.

We claim:

1. A high-pressure discharge lamp comprising a pressure chamber having two opposite end regions and delimited by a cylindrical envelope made of glass, an electrode provided at each of the two opposite end regions, each of the electrodes projecting into the pressure chamber and being arranged in the pressure chamber respectively as an anode and a cathode, and a discharge chamber formed between the electrodes, the anode comprising a through opening ending in the discharge chamber, the opening comprising a bore not running parallel to a longitudinal axis connected to an axial bore, wherein the two opposite end regions of the pressure chamber are designed differently at least outside of the discharge chamber.

2. The high-pressure discharge lamp according to claim 1, wherein the cylindrical envelope is designed as a tube closed at both ends.

3. The high-pressure discharge lamp according to claim 1, wherein the cylindrical envelope is made of quartz glass.

4. The high-pressure discharge lamp according to claim 1, wherein at least one of the electrodes is cylindrical in shape.

5. The high-pressure discharge lamp according to claim 1, wherein a flow resistance in the end region comprising the anode is less than a flow resistance in the end region comprising the cathode.

6. The high-pressure discharge lamp according to claim 1, wherein a spacing between the electrode and the cylindrical envelope at the end region comprising the anode exceeds a spacing between the electrode and the cylindrical envelope at the end region comprising the cathode by at least approximately 200 μm.

7. The high-pressure discharge lamp according to claim 1, wherein a cold fill pressure of the pressure chamber is in a range of about 1.5 to 3 bar.

8. The high-pressure discharge lamp according to claim 1, wherein at least one of the electrodes, at its region toward the associated end of the pressure chamber, has a cross-section that is reduced as compared with its region toward the discharge chamber.

9. The high-pressure discharge lamp according to claim 1, wherein a radial spacing between the cylindrical envelope and at least one of the electrodes is greater at a lateral region toward the associated end of the pressure chamber than at a lateral region toward the discharge chamber.

10. The high-pressure discharge lamp according to claim 1, wherein a diameter of the cylindrical envelope is reduced at least in the region of one of the electrodes, wherein a radial spacing from the one electrode is reduced.

11. The high-pressure discharge lamp according to claim 10, wherein the one electrode is the cathode.

* * * * *